United States Patent [19]

Croft et al.

[11] 4,259,558

[45] Mar. 31, 1981

[54] MULTIPLE CANTILEVER SPRING CONTACT SWITCH

[75] Inventors: Stanley A. Croft, Nashville, Tenn.; Bruce I. Dolan, Nepean; Pak-Jong Chu, Ottawa, both of Canada

[73] Assignee: Northern Telecom Limited, Montreal, Canada

[21] Appl. No.: 67,476

[22] Filed: Aug. 17, 1979

[51] Int. Cl.[3] ..... H01H 1/26; H01H 50/56

[52] U.S. Cl. ..... 200/283; 200/6 C; 200/284; 200/303

[58] Field of Search ..... 200/283, 284, 246, 307, 200/280, 243, 1 A, 1 TK, 6 C, 303

[56] References Cited

U.S. PATENT DOCUMENTS

| | | | |
|---|---|---|---|
| 3,020,375 | 2/1962 | William | 200/283 |
| 3,182,159 | 5/1965 | Claesson et al. | 200/283 |
| 3,204,072 | 8/1965 | Maynard | 200/283 |
| 3,790,733 | 2/1974 | Pohl | 200/283 |
| 4,024,362 | 5/1977 | Morgan et al. | 200/1 TK |
| 4,052,581 | 10/1977 | Matsui | 200/283 |
| 4,083,023 | 4/1978 | Cherny et al. | 200/283 |

*Primary Examiner*—Willis Little

*Attorney, Agent, or Firm*—Sidney T. Jelly

[57] ABSTRACT

A multiple cantilever spring contact switch has a plurality of cantilever spring contacts, arranged in one or more series with the spring contacts of a series each clamped at one end in grooves which have base surfaces inclined relative to each other. By this means, predetermined angular inclinations are imposed on the spring contacts, urging the contacts into a correct positional relationship. Particularly the individual contact members are positioned side-by-side at their clamping positions, the free ends of one or more contact members extended laterally to overlie each other. In another arrangement two or more contacts can be stacked, with a spacer member between adjacent contacts, the spacer member having one or more of said grooves.

16 Claims, 16 Drawing Figures

MULTIPLE CANTILEVER SPRING CONTACT SWITCH

This invention relates to multiple cantilever spring contact switches, in which a plurality of series of spring contact members are arranged side-by-side, and is particularly applicable to hook swithces for telephones and similar switches.

In many forms of cantilever spring contact switches, such as are used for hook switches for telephones, a plurality of cantilever contact members are stacked, that is assembled one on top of another, and switch contacts are made and broken by flexing of one or more of the spring contact members relative to others in the stack or pile. Such an arrangement requires very accurate positional relationship between the spring contact members.

In the present invention, although a number of spring contact members are effectively stacked, the clamped ends of the contact members are held in grooves in a mounting assembly, the grooves having base surfaces which are inclined relative to each other so as to impose predetermined angular inclinations to the contact members. Such an arrangement urges the cantilever spring contact members into the correct positional relationship as the switch is assembled. In a particular arrangement the individual contact members are positioned side-by-side at their mounting positions, the ends of one of more contact members remote from the mounting position being extended laterally so that the free ends of the contact members overlie each other.

The invention will be readily understood by the following description in conjunction with the accompanying drawings, in which.

Figure 1:
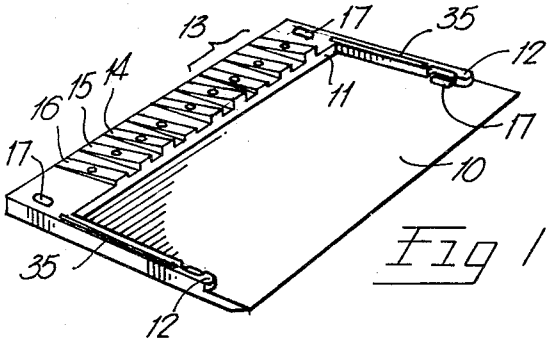
FIG. 1 is a perspective view of one part of a two part mounting assembly for the contact members.
Figure 3:
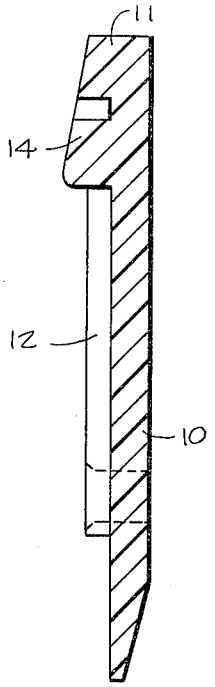
FIGS. 3, 4 and 5 are cross-sections on the lines III—III, IV—IV and V—V respectively of FIG. 2.
Figure 4:
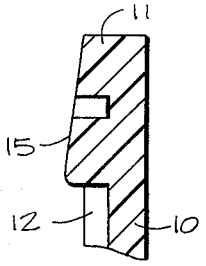
Figure 5:
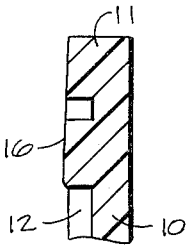
Figure 8:
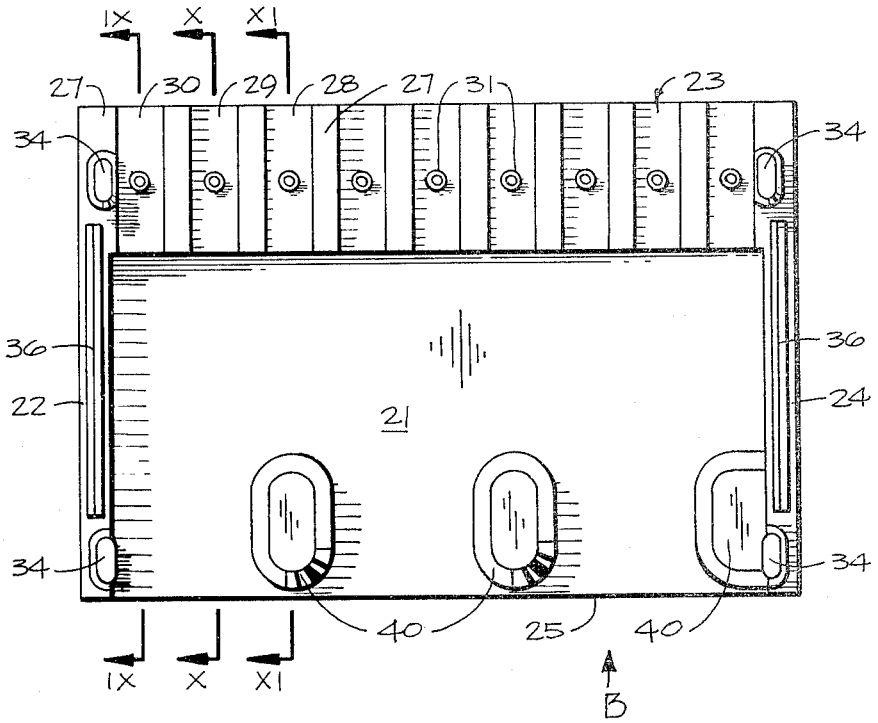
FIG. 8 is a plan view of the part of FIG. 7.

The mounting assembly, In the the embodiment illustrated, comprises two parts, for convenience referred to as a base and a top spaced to define a contact enclosure. The top illustrated in FIGS. 1 to 6, comprises a flat planar web 10 having a raised rim 11 along one edge and ribs 12 along each side. The raised rim carries a plurality of protrusions arranged in series. In the example illustrated three series of protrusions are provided, each series comprising three protrusions having inclined surfaces. Thus, as seen in FIG. 1, a series is indicated at 13, and the protrusions at 14, 15 and 16. A small hole 17 is formed in the rim 11 at each protrusion 14, 15 and 16 for reception of a locating pin on the top. The protrusions 14, 15 and 16 have inclined top surfaces, and in the example illustrated in FIGS. 1 to 6, protrusion 14 is inclined upwardly at a greater angle than the protrusion 15 and 15 is at a greater angle than 16. At each series 13 there is provided three positions at 14, 15 and 16, and a cantilever spring contact member is mounted at each position, as will be described. The relative angular dispositions of the surfaces 14, 15 and 16 at the various positions are clearly seen in FIGS. 3, 4 and 5 respectively.

Recesses 17 are formed at each side for reception of small protrusions on the base, for alignment, as will be described.

Figure 7:
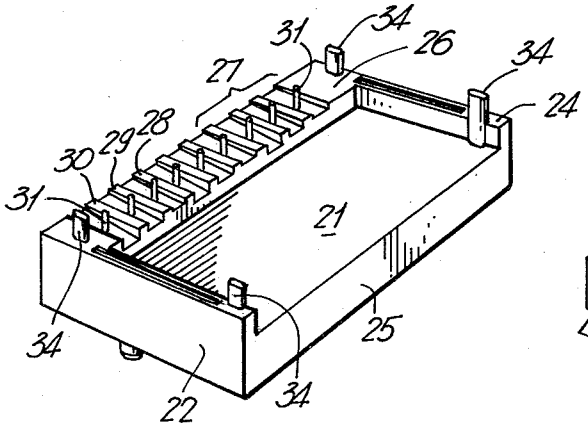
FIG. 7 is a perspective view of the other part of the mounting assembly, upside down relative to the part of FIG. 1.
Figure 12:
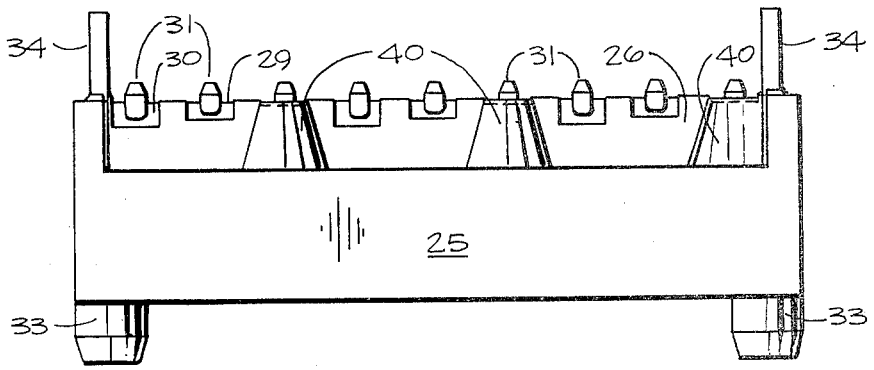
FIG. 12 is a view in the direction of arrow B in FIG. 8.
Figure 11:
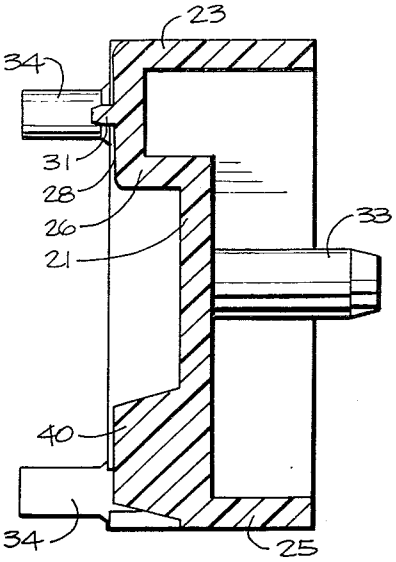
FIGS. 9, 10 and 11 are cross-sections on the lines IX—IX, X—X and XI—XI respectively of FIG. 8.
Figure 10:
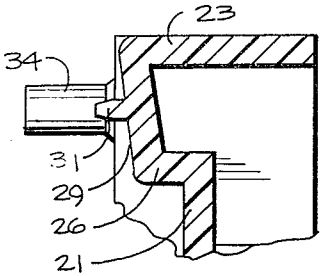
Figure 9:
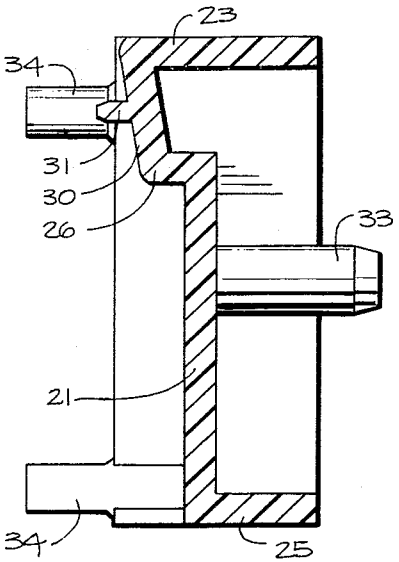

The base is illustrated in FIGS. 7 to 12 and comprises a box-like member 20 having an intermediately positioned web 21 and four side members 22, 23, 24 and 25. Side members 22, 23 and 24 extend both sides of the web 21 while side 25 extends only on one side. Adjacent to the side member 23, a raised portion or rim 26 extends longitudinally. This can be formed by a localized thickening of the web 21, but in the example illustrated is formed by in effect, raising the web adjacent to the side member 23. This raised portion 26 is formed to give a number of recesses arranged in series. In the example, three series each of three recesses, are provided to cooperate with the positions on the base. In FIG. 7 a series is indicated at 27 and a series comprises recesses 28, 29 and 30. Recess 28 is, only slightly inclined, recess 29 more inclined than 28 and 30 more inclined than recess 29. A pin 31 is formed at each recess. Extending from the side members 22 and 24, in a direction opposite to that in which the recesses face, are two pins 33 which can be provided for locating the switch assembly on a circuit board or other member. Four protruding lugs 34 extend upwards, as seen in FIG. 12, these protrusions entering the recesses 17 in the top.

The inclination of the base surfaces of the recesses 29 and 30 matches the inclination of the surfaces of the protrusions 15 and 14 respectively. The pins 31 fit into the holes 17, and the side members 22 and 24 abut ribs 12 and 10 respectively, when assembled.

The contact members are positioned on the base by positioning a contact member in each recess 28, 29 and 30. Holes in the contact members fit over the pins 31 to provide correct positioning. The top is then applied. The top and base are held tightly together while bonded together. Such bonding can be by an adhesive, by sonic bonding or welding, or by any other convenient and suitable method. In the example illustrated, Vee shaped ribs 35 are formed on the ribs 12 and Vee grooves 36 on side members 22 and 24, for sonic welding of top and base. This clamps one end of each cantilever spring contact member between two surfaces, one on the base and one on the top. The inclination of the surfaces of the recesses and protrusions constrains the contact members at their fixed ends to a particular relative inclination.

Figure 13:
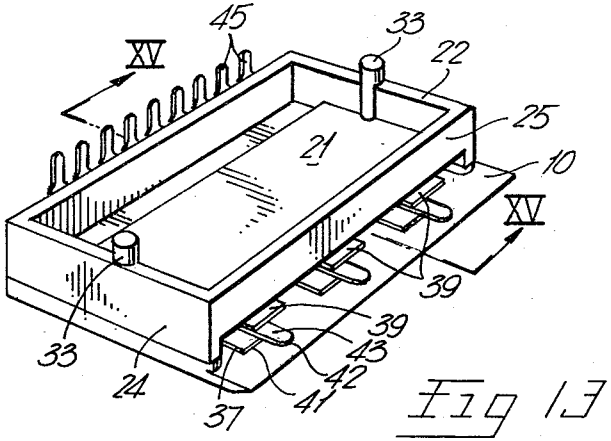
FIG. 13 is a perspective view of an assembled mounting assembly, with cantilever spring contact members.
Figure 15:
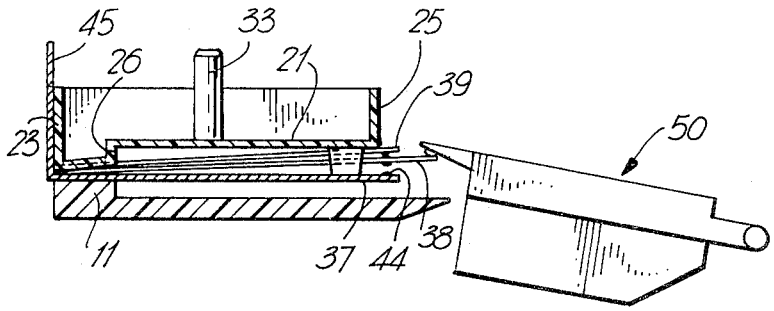
FIG. 15 is a cross-section on the line XV—XV of FIG. 14, but also including the operating lever.

FIGS. 13 and 15 illustrate the relative positioning of the cantilever spring contact members, indicated at 37, 38 and 39. Contact member 37 is held between the surface at position 16 and the base surface of recess 28, contact member 38 is held between the inclined surface of protrusion 15 and the base surface of recess 29, and contact member 39 is held between the inclined surface of protrusion 14 and the base surface of recess 30. In the example, to provide correct positioning of contact member 37, bosses 40 are formed on the web 21, aligned with each surface 28. The contact members 37 rest on the bosses. The provision of the bosses 40, provides some overide action. Contact member 37 is constrained to lie against the surface of the intermediate web 21 and contact 36 is constrained to an intermediate position. This is seen in FIG. 15.

The free ends of contact members 37 and 39 are extended laterally towards the contact member 38, the extended end 41 of contact member 37 underlying the free end 42 of contact member 38 and the extended end 43 of contact member 39 overlying the free end 42 of contact member 38. Localized dots of contact metal 44 are provided at the free end of each contact member to improve contact characteristics. To improve contact point alignment the dots can be circular on contact members 37 and 39 and lateral bars on contact member 38. The contact members 37, 38 and 39 are also provided with tails or extensions 45 for attachment of conductors. Depending upon the particular use of the switch, the extensions 45 can be reduced in width at their ends to pass through holes in a circuit board. The ends can then be soldered to the circuit pattern on the board. However other ways of connecting electrical conductors to the cantilever spring contact members can be provided.

The particular form of switch assembly illustrated is a transfer type, in that contact of a central contact member is transferred from a contact member on one side to a contact member on the other. Other types of switches can be provided. Actuation of the contact members, contact members 38 in the example illustrated, is by an actuating lever as illustrated in FIG. 14 and in position relative to the switch assembly in FIG. 15.

Figure 14:
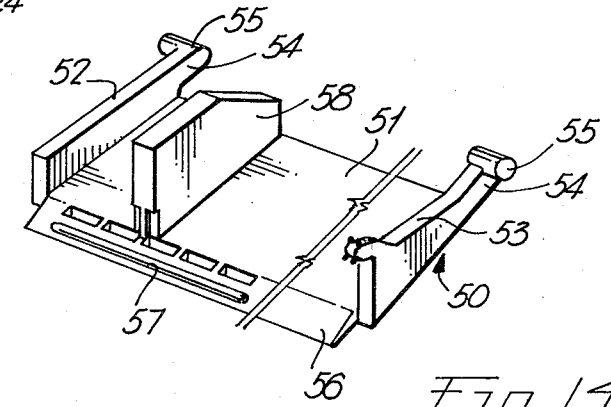
FIG. 14 is a perspective view of an operating lever for actuating the spring members, the lever upside down relative to FIG. 13.

As illustrated in FIG. 14, the lever is upside down as compared with the switch assembly in FIGS. 13 and 15. The lever, indicated generally at 50, comprises a flat web 51 with flanges 52 and 53, one at each end. At the rear ends of the flanges are extensions 54 carrying cylindrically shaped members 55. Members 55 are in axial alignment and provide for pivotal mounting of the lever 50. The forward edge 56 of the web 51 extends forward of the flanges and is tapered. Formed on the surface of the forward edge is a ridge 57 which, in use, bears on the free ends 42 of the cantilever spring contact members 38. At a position intermediate the flanges 52 and 53 is a further, thick, flange 58. In the particular example, which is for a hook switch for a telephone, flange 58 would extend through the telephone set casing for actuation by the telephone handset. The relative positioning of the lever 50 and the switch assembly is seen in FIG. 15. One of the flanges, flange 53 in the example, has a hook shaped extension 59 at its forward end. This can engage under a limiting member, not shown, to limit pivotal movement of the lever away from the contact members.

While the individual contact members are generally positioned side-by-side, in the arrangement as illustrated in FIGS. 1 to 15, it is possible to use the same basic feature of the invention - inclined clamping surfaces, with two or more contact members stacked vertically. In such an arrangement a spacer is provided between each pair of stacked contact members, and the surfaces of the spacer are recessed and inclined relative to each other.

Figure 2:
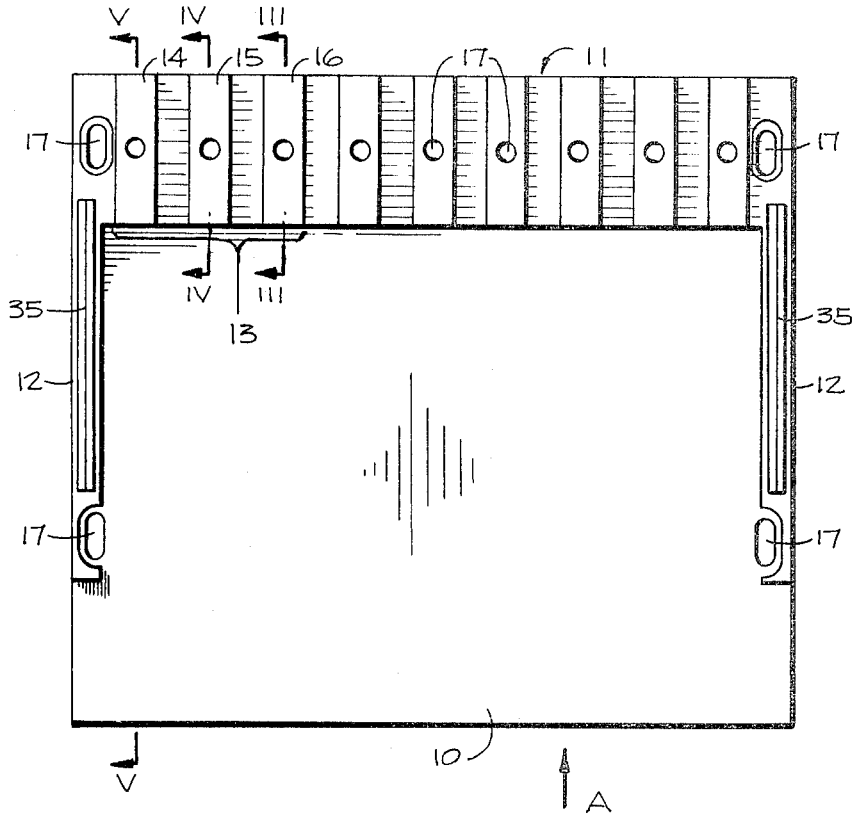
FIG. 2 is a plan view of the part in FIG. 1.
Figure 6:
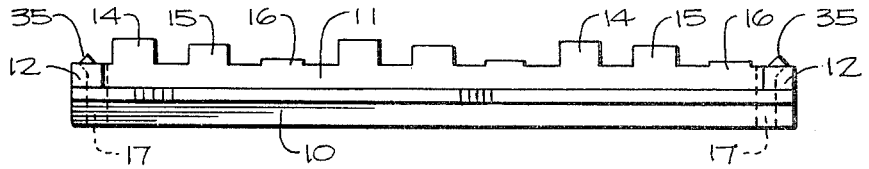
FIG. 6 is a view in the direction of arrow A in FIG. 2.
Figure 16:
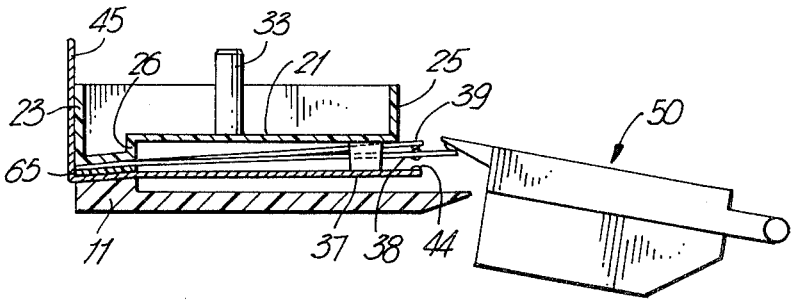
FIG. 16 is a similar view to that of FIG. 15, but illustrating a modification thereof.

Thus, as illustrated in FIG. 16, contact member 37 rests on an inclined surface in a recess in the rim 11, for example as at 16 in FIG. 2. There is positioned over the contact members 37 a spacer 65. This spacer, which is of electrically insulating material, has its surface in contact with the contact member 37 at the same inclination as surface 28 in FIG. 8, and its other surface is at a greater angle, for example at the same inclination as the surface 15 in FIG. 2. On the spacer will rest contact member 38. It will be seen that the two contact members 37 and 38 will be inclined relative to each other. The third contact member can be laterally displaced, as in FIGS. 2 and 8 or if desired, a further spacer, not shown, can be used with differentially inclined surfaces. This will provide vertical stacking, with a predetermined inclination or bias applied to each contact member by the differentially inclined surfaces at the clamped ends. Lateral extension of the free ends of the contact members is not required for those contact members vertically stacked.

With variations in design, variations in switching sequences can be obtained. Thus the ridge 57 can be of differing heights to provide sequential switching. While illustrated in the form of a transfer switch arrangement, straight forward make or break formations can be provided. While three series of contact members have been illustrated, larger or smaller numbers of series can be provided, down to one series. Similarly, more or less than three contact members can be provided for each series, and each series of contact members does not necessarily have the same number of contact members.

While the contact members have been shown as actuated by a pivotted member, that is lever 50, they can be actuated with a plunger form of member having a straight line movement. Other actuating actions can also be readily used.

What is claimed is:

1. A multiple cantilever spring contact switch comprising:

a base and a top, each having a planar web, the webs spaced apart to define a contact enclosure;

a rim along one edge of each of said base and top, said rims in opposition;

clamping surfaces at said rims;

cantilever spring contact members clamped at one end between said clamping surfaces, said clamping surfaces inclined relative to each other whereby said contact members extend at different inclinations across said enclosure, electrically isolated from each other;

contact positions at free ends of said contact members, one of said contact members extended at said free end beyond said enclosure for actuation by an actuating member;

means for connecting an electrical conductor to each contact member; and actuation of said extended contact member changing contact conditions between said contact members.

2. A switch as claimed in claim 1, said clamping surfaces spaced apart along each of said rims, to form at least one series of clamping positions, the clamping surfaces of a series inclined relative to each other in opposed pairs, a contact member between each pair of clamping surfaces.

3. A switch as claimed in claim 1, including at least one spacer between said rims, clamping surfaces on said spacer in opposition to said clamping surfaces on said rims, each clamping surface on the spacer parallel to the related clamping surface on the rims to form pairs of clamping surfaces, a contact member clamped between each pair of clamping surfaces, whereby at least two contact members are clamped in stacked array and inclined at different angles.

4. A switch as claimed in claim 2, said base comprising a box-like member having side members extending from said planar web in a direction opposite to said rim, the rim extending along one edge, and a side member along each side, the side members along each side also extending from said planar web in the same direction as said rim;

said top including ribs extending from said planar web, along each side thereof, the ribs extending in the same direction as said rim;

said ribs and said side members along each side of said base in opposition and defining three sides of said contact enclosure, the fourth side of said enclosure open.

5. A switch as claimed in claim 4, said series of clamping surfaces comprising recesses in said rim of said base and protrusions on said rim of said top.

6. A switch as claimed in claim 4 or 5, each said series of clamping surfaces comprising at least three pairs of opposed clamping surfaces positioned side-by-side, each pair inclined relative to each other pair.

7. A switch as claimed in claim 4 or 5, each said series of clamping surfaces comprising at least three pairs of opposed clamping surfaces positioned side-by-side in sequence, the pairs of clamping surfaces at successively increased inclination.

8. A switch as claimed in claim 4, each said series of clamping surfaces comprising at least three pairs of opposed clamping surfaces positioned side-by-side, a first one of said contact members being extended at said free end, each of the other contact members including a lateral extension at said free ends, said lateral extensions extending in overlapping relationship with said free end of said first one, said extension of said free end of said first one of said contact members extending beyond said external extensions on said other contact members.

9. A switch as claimed in claim 8, said series of clamping surfaces comprising recesses in said rim of said base and protrusions on said rim of said top.

10. A switch as claimed in claim 8, said first one of said contact members positioned intermediate the other contact members.

11. A switch as claimed in claim 10, a series of said contact members comprising a bottom contact member, an intermediate contact member and a top contact member, the bottom contact member adjacent to said base and said top member adjacent to said top.

12. A switch as claimed in claim 11, including bosses formed on said planar web of said base, said bosses extending towards said top, said bosses in contact with and biasing said top contact member to a predetermined position.

13. A switch as claimed in claim 9, including a pin extending from the clamping surface in each recess and a hole in each clamping surface of each protrusion, said pins entered in said holes, and a hole in the contact members, said pins extending through said holes in said contact members.

14. A switch as claimed in claim 1, including locating pins extending from said base, in a direction away from said top, said pins adapted to fit in locating holes in a support member.

15. A switch as claimed in claim 1, 4 or 8, including an actuating member comprising a flat web having a forward edge, and a ridge at said forward edge, said ridge positioned to engage said extended end of said one of said contact members.

16. A switch as claimed in claim 3, said base comprising a box-like member having side members extending from said planar web in a direction opposite to said rim, the rim extending along one edge, and a side member extending along each side, the side members along each side also extending from said planar web in the same direction as said rim;

said top including ribs extending from said planar web along each side thereof, the ribs extending in the same direction as said rim;

said ribs and said side members along each side of said base in opposition and defining three sides of said contact enclosure, the fourth side of said enclosure open;

said series of clamping surfaces including a recess in said rim of said base, a cooperating protrusion on one surface of a spacer, a recess on the other surface of said spacer, and a cooperating protrusion on said rim of said top, each recess and cooperating protrusion defining a pair of clamping surfaces, the pairs of clamping surfaces inclined relative to each other.

* * * * *